US011760095B2

(12) United States Patent
Takahashi

(10) Patent No.: US 11,760,095 B2
(45) Date of Patent: Sep. 19, 2023

(54) IMAGE RECORDING APPARATUS

(71) Applicant: CANON KABUSHIKI KAISHA, Tokyo (JP)

(72) Inventor: Sho Takahashi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 77 days.

(21) Appl. No.: 17/336,032

(22) Filed: Jun. 1, 2021

(65) Prior Publication Data

US 2021/0379895 A1 Dec. 9, 2021

(30) Foreign Application Priority Data

Jun. 9, 2020 (JP) ..... 2020-100426

(51) Int. Cl.
*B41J 2/165* (2006.01)

(52) U.S. Cl.
CPC ..... *B41J 2/16541* (2013.01); *B41J 2/16535* (2013.01); *B41J 2/16538* (2013.01); *B41J 2002/16582* (2013.01)

(58) Field of Classification Search
CPC ..... B41J 2/16541; B41J 2/16535; B41J 2/16538; B41J 2002/16582
See application file for complete search history.

(56) References Cited

U.S. PATENT DOCUMENTS 5,963,229 A * 10/1999 Fukuoka ..... B41J 2/16541 347/31

* cited by examiner

*Primary Examiner* — Geoffrey S Mruk
(74) *Attorney, Agent, or Firm* — Venable LLP

(57) ABSTRACT

A recording apparatus has a receiving member provided at a carriage having thereon a recording head and reciprocally moving, and receiving a liquid cleared away from a wiper for wiping and cleaning the recording head by a cleaner member. The cleaner member can assume, with respect to the carriage, a first position capable of cleaning the wiper, and a second position allowing the receiving member to receive the liquid cleared away from the wiper by the cleaner member.

11 Claims, 11 Drawing Sheets

IMAGE RECORDING APPARATUS

BACKGROUND OF THE INVENTION

Field of the Invention

The present invention relates to an image recording apparatus for recording an image on a to-be-recorded material by discharging an ink onto the to-be-recorded material from a recording head mounted on a reciprocally moving carriage, and a cleaning mechanical portion of the image recording apparatus.

Description of the Related Art

In a serial type image recording apparatus adopting a serial scanning system that reciprocally moves in the direction (main scanning direction) crossing with the conveying direction (sub scanning direction) of a to-be-recorded material, an image is recorded (mainly scanned) by recording means mounted on a carriage moving along the to-be-recorded material. After completion of recording for one line, a prescribed amount of paper feed (pitch conveying) is performed, and the to-be-recorded material stopped again afterwards is subjected to recording (main scanning) of a next-line image. This operation is repeated, thereby performing recording on the entirety of the to-be-recorded material.

Among image recording apparatuses such as the above-mentioned apparatus, an ink jet type image recording apparatus (ink jet recording apparatus) is configured to perform recording by discharging an ink from recording means (recording head) to a to-be-recorded material and is able to record a high definition image at a high speed, and has advantages such as low running cost, and moreover easiness of recording a color image using multi-color inks.

The recording head for use in an ink jet recording apparatus is provided with a passage from an ink retention portion (ink tank portion) to an ink discharge portion. Thus, every time when ink discharge is performed, the ink is successively fed from the ink retention portion to the ink discharge portion. In the recording apparatus using such a recording head, for a case where the fixed ink and foreign matters such as dust and bubbles in the vicinity of the ink discharge port are removed (cleaned), a mechanical portion (recovery mechanical portion) for cleaning the recording head is generally mounted for the purpose of stabilizing the ink discharge operation, and obtaining favorable appearance of the image.

As one of the cleaning operations, there is a method using a wiper blade to be in sliding contact with the discharge port surface of the recording head in order to prevent the deflection of the discharge direction of the ink. In the case of this method, the wiper blade and the recording head are relatively moved, thereby wiping away ink droplets and foreign matters such as dust deposited in the vicinity of the discharge port by a wiper blade (which will be referred to as "wiping").

As the wiper blade, a member having elasticity such as urethane rubber is generally used. The performances of the wiper blade depend upon the materials and the mechanical setting conditions. In order to always keep the performances, the contamination on the surface of the wiper blade itself is preferably reduced. To this end, as a cleaning mechanism of the wiper blade for clearing away the ink droplets, and the like, deposited on the wiper blade, by wiping, a blade cleaner is often provided. When wiping is performed by the movement of the carriage having the recording head mounted thereon, the blade cleaner is often integrally provided on the carriage. Further, provision of a rib on the blade cleaner can hinder the movement of the ink cleared away (Japanese Patent Application Publication No. 2007-160559).

SUMMARY OF THE INVENTION

However, with the conventional recording apparatus, the blade cleaner is fixed on the carriage. For this reason, with an increase in wiping operations, more ink is retained on the blade cleaner, and may drop on the to-be-recorded material during printing. In that case, the retained ink may come into contact with the to-be-recorded material conveying portion immediately under the carriage during scanning of the carriage, and may contaminate the fed to-be-recorded material.

It is an object of the present invention to provide a technology capable of keeping the performances of the blade cleaner for a long term.

In order to attain the object, a recording apparatus of the present invention includes:

a carriage having thereon a recording head having a discharge port surface including a discharge port for discharging a liquid, and reciprocally moving in a main scanning direction;

a wiper relatively moving with respect to the recording head due to a movement of the carriage in the main scanning direction, and wiping the discharge port surface;

a cleaner member provided at the carriage and relatively moving with respect to the wiper due to the movement of the carriage, and cleaning the wiper; and a receiving member provided at the carriage and receiving a liquid cleared away from the wiper by the cleaner member, and wherein the cleaner member is configured be movable, with respect to the carriage, between a first position capable of cleaning the wiper and a second position allowing the receiving member to receive the liquid cleared away from the wiper by the cleaner member.

The present invention makes it possible to keep the performances of the blade cleaner for a long term.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Embodiment 1

Figure 1:
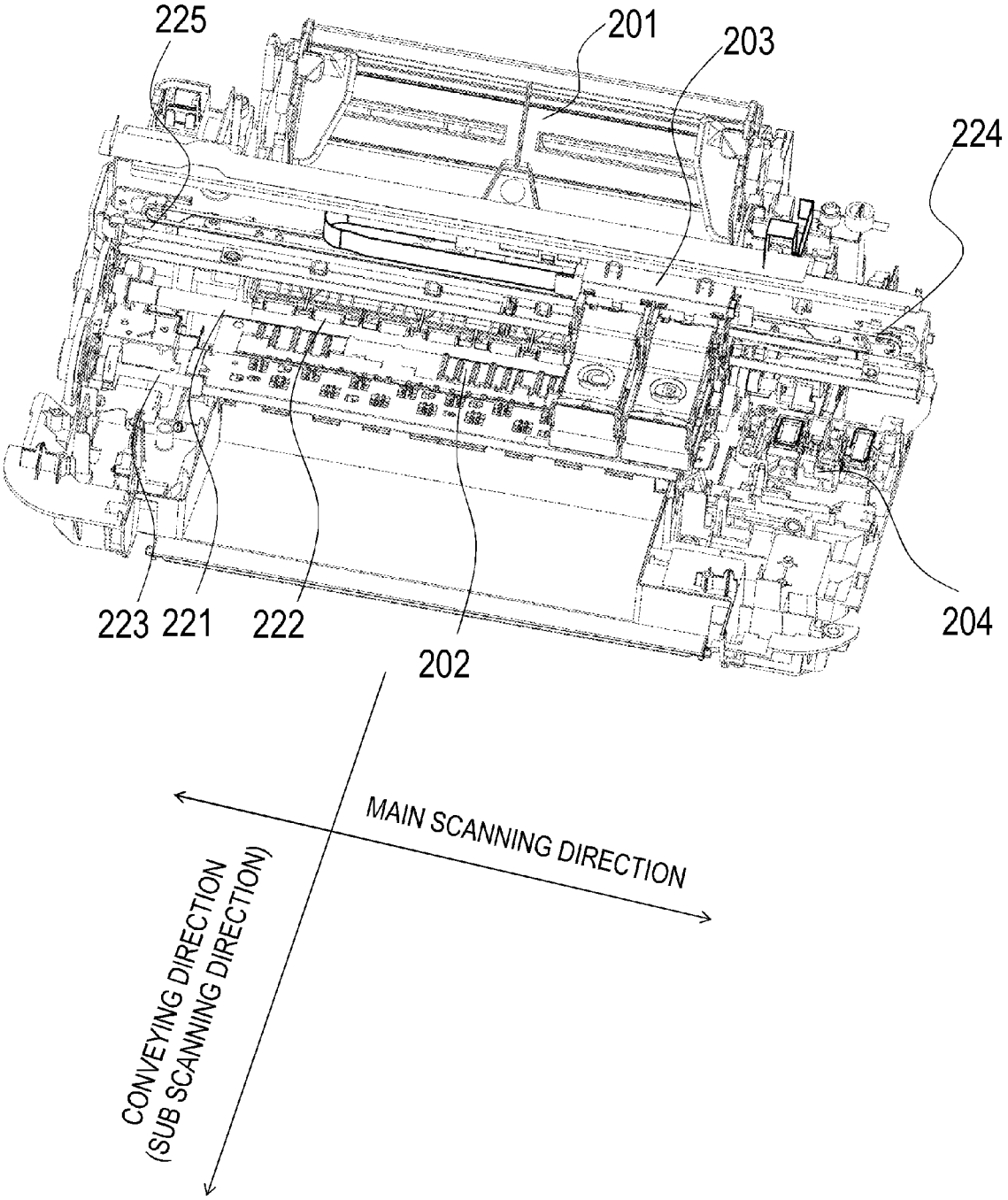
FIG. 1 is a schematic perspective view of a recording apparatus in accordance with an embodiment of the present invention.

FIG. 1 is a schematic perspective view showing a configuration of an ink jet recording apparatus (below, a recording apparatus) as an image recording apparatus in accordance with an embodiment of the present invention. As shown in FIG. 1, the recording apparatus is provided with a paper feed portion 201, a conveying portion 202, a recording mechanical portion (carriage unit) 203, and a cleaning mechanical portion (recovery mechanical portion) 204. The paper feed portion 201 feeds a to-be-recorded material (recording medium) such as a recording paper sheet into the recording apparatus main body. The conveying portion 202 feeds a to-be-recorded material through the inside of the recording apparatus main body (such as the recording portion). The recording mechanical portion 203 records an image (including a letter, a sign, and the lie) on the to-be-recorded material based on image information. The cleaning mechanical portion 204 is provided for keeping the appearance of the image formed by the recording mechanical portion 203.

The to-be-recorded materials such as recording paper sheets loaded on the paper feed portion 201 are separated one by one and fed out by a paper feed roller driven by a paper feed/conveying motor 205, and are fed to the conveying portion 202. The to-be-recorded material fed to the conveying portion 202 is conveyed by the frictional conveying force by a conveying roller 221 driven by the paper feed/conveying motor 205 and a pinch roller 222 pressed by the conveying roller 221 through the recording portion. The to-be-recorded material undergoes recording of an image (including a letter, a sign, and the like) thereon by the recording mechanical portion (carriage unit) 203 while being fed (pitch conveyed) at the recording portion. The to-be-recorded material having an image recorded thereon is discharged to the outside of the apparatus main body by the conveying force due to being interposed between the discharge roller 223 driven in conjunction with the conveying roller 221 and a spur cooperating with the discharge roller 223.

Figure 2A:
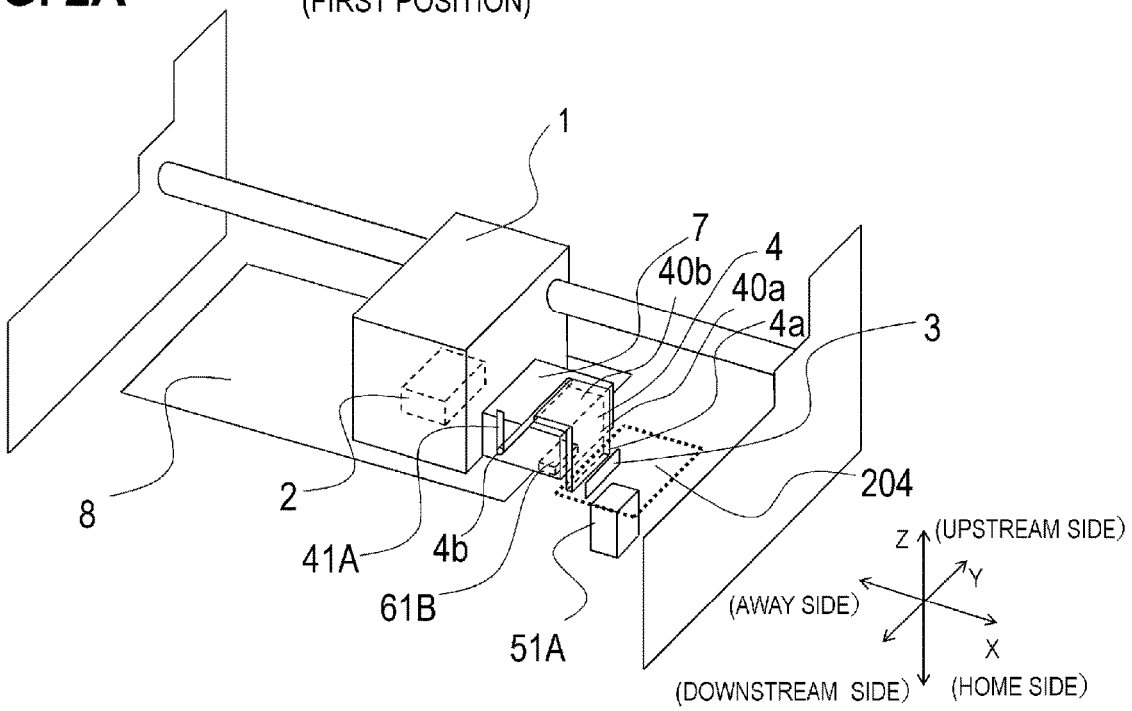
FIGS. 2A and 2B are perspective views showing the outline of a recording apparatus and a recovery apparatus in Embodiment 1 of the present invention.
Figure 2B:
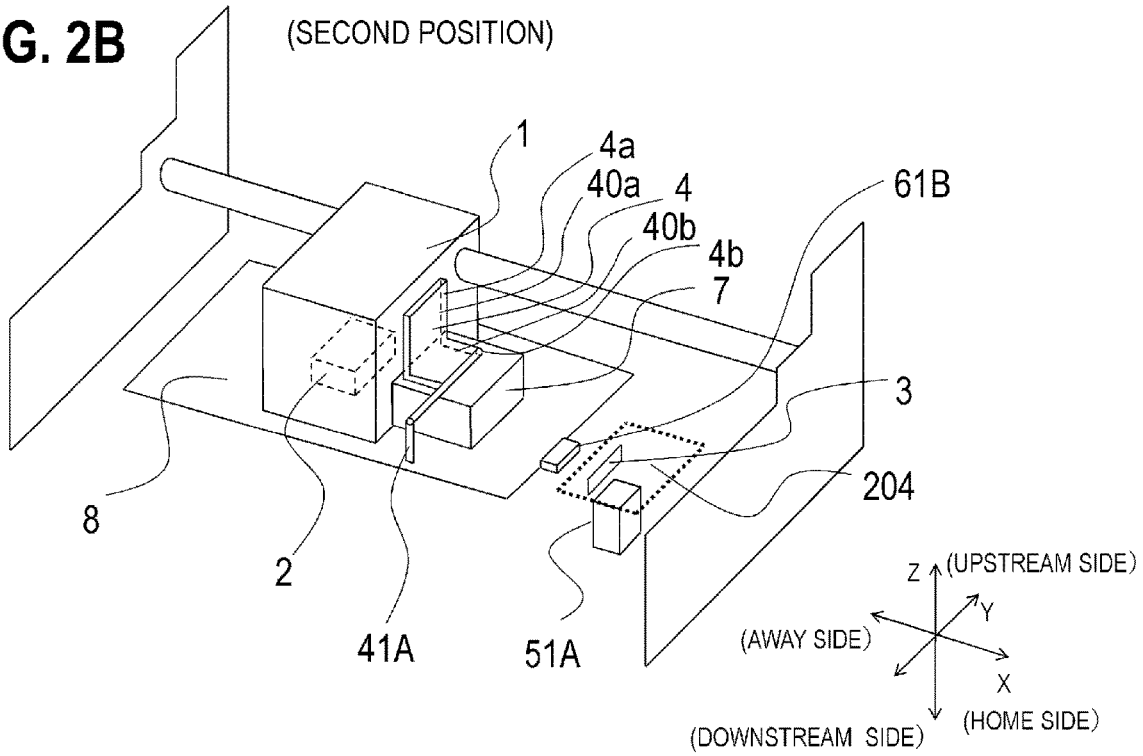

The recording mechanical portion (carriage unit) 203 includes a carriage 1, a recording head 2 as a recording means, and the like guided and supported reciprocally movably in the main scanning direction in the inside of the apparatus main body (see FIGS. 2A and 2B). Namely, the carriage 1 mounting the recording head 2 thereon is guided and supported reciprocally movably along the guide rail set at the apparatus main body. To the carriage 1, the driving force from a carriage motor 2040 (see FIG. 11) is transmitted through a carriage belt 224, and the carriage 1 is reciprocally moved along the guide rail by the driving force of the carriage motor 2040. At this step, an encoder sensor (not shown) mounted on the carriage unit 203 senses the slit provided on an encoder scale 225, thereby recognizing the position and the speed in the main scanning direction of the carriage unit 203. Then, the recording operation of the recording head 2 performed in synchronization with the reciprocal movement (main scanning) of the carriage 1 and the conveying (sub scanning) for each prescribed pitch of the to-be-recorded material are repeated, thereby performing recording of the whole to-be-recorded materials.

Figure 11:
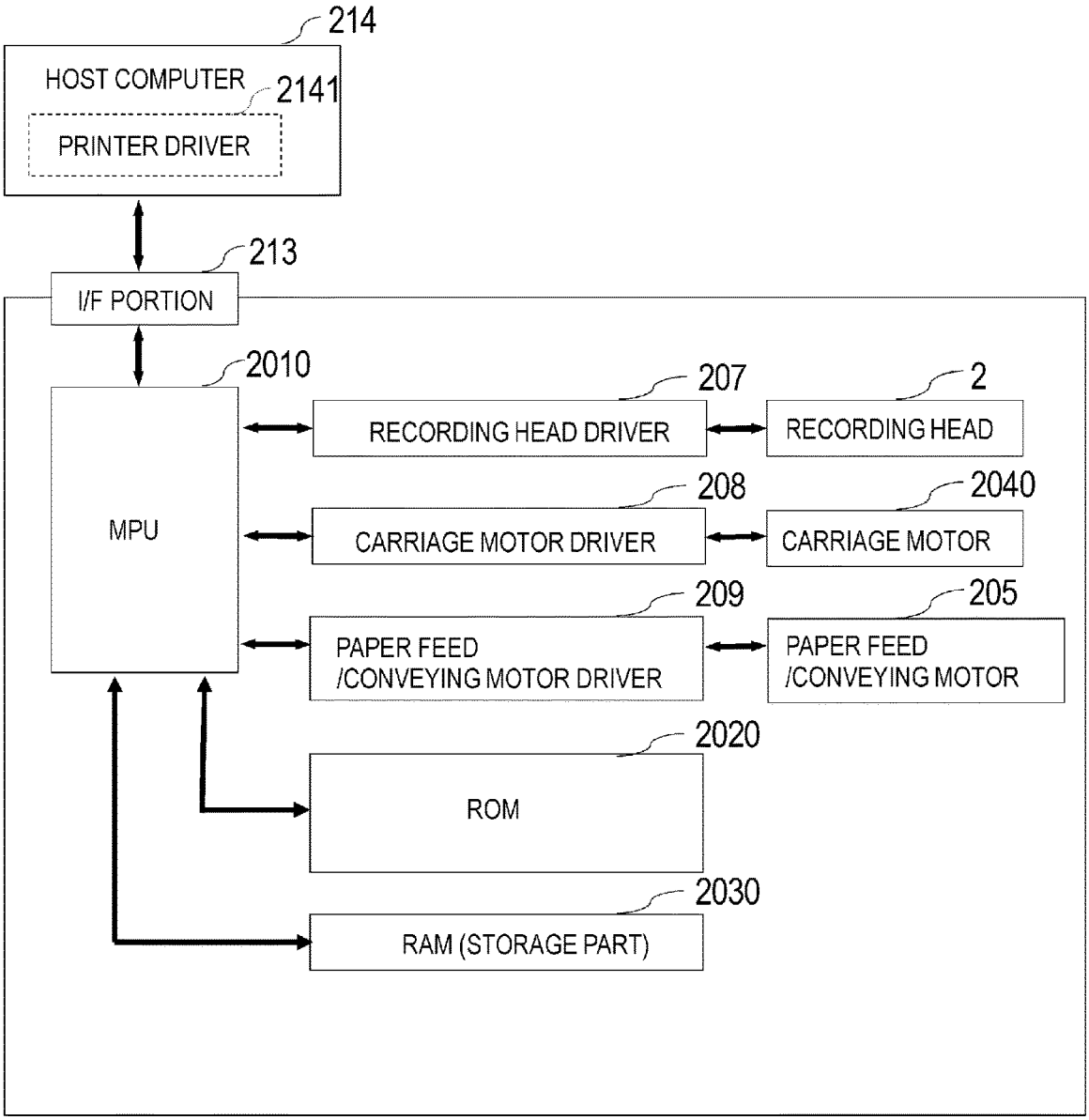
FIG. 11 is a block view of a control system in the recording apparatus.

FIG. 11 is a block view of the control system in the recording apparatus of the present embodiment. The recording apparatus is connected to a printer driver 2141 of a host computer 214 via an I/F portion 213. In the inside of the recording apparatus, the I/F portion 213 and a MPU 2010 for controlling the operations of respective portions and processing of data are connected to each other. The MPU 2010 is connected with a ROM 2020 for storing programs to be executed by the MPU 2010 and data, and a RAM 2030 for temporarily storing the processing data to be executed by the MPU 2010 and the data received from the host computer 214. Further, the MPU 2010 is connected with a recording head driver 207, a carriage motor driver 208, and a paper feed/conveying motor driver 209. The recording head 2 is controlled by the recording head driver 207. The carriage motor 2040 for driving the carriage 1 is controlled by the carriage motor driver 208, and the paper feed/conveying motor 205 is controlled by the paper feed/conveying motor driver 209. The host computer 214 is provided with a printer driver 2141 for compiling recording information such as a recording image and the appearance of the recording image, and communicating with the recording apparatus when execution of the recording operation is instructed by a user. The MPU 2010 executes passing, and the like of the recording image, or the like with the host computer 214 via the I/F portion 213.

FIGS. 2A and 2B are schematic perspective views showing a state in which a blade cleaner 4 formed at the carriage 1, a platen 8 for supporting the to-be-recorded material at the position opposed to the recording head 2, and the like are incorporated in Embodiment 1 of the present invention. FIG. 2A shows the state in which the blade cleaner 4 is at a first position described later, and FIG. 2B shows the state in which the blade cleaner 4 is at a second position described later. Below, it is assumed that in the main scanning direction, the side closer to the cleaning mechanical portion (recovery mechanical portion) 204 is referred to as the HOME side, and the distant side is referred to as the AWAY side. The region in the vicinity of the HOME side end of the migration path of the carriage 1 becomes the region to which the to-be-recorded material is conveyed, namely, the region out of the region (print region) where the carriage 1 performs the print operation, and becomes the recovery operation region (recovery region) where a prescribed recovery operation is performed. Namely, this is the region where cleaning (wiping) of the discharge port surface 2*a* (see FIG. 4) of the recording head 2 by the wiper blade (wiper) 3, and clearing away of an ink from the wiper blade 3 by the blade cleaner 4 are performed. Most region on the AWAY side except for such a recovery operation region in the migration path for the carriage 1 becomes the print region where the recording head 2 discharges an ink as liquid, and performs the recording operation. The blade cleaner 4 has no particular restriction on the material, shape, and the like so long as it can clear away an ink from the wiper blade 3 by contact with the wiper blade 3.

In FIGS. 2A and 2B, the blade cleaner 4 as a blade cleaner member (cleaner member) is mounted displaceably with respect to the carriage 1. Specifically, the blade cleaner 4 is configured changeably in posture by rotation on the carriage 1. The state where the blade cleaner 4 is in a first posture in which an ink clearing away portion 4*a* of the blade cleaner 4 protrudes toward the side approaching the upper surface of the platen 8, and can come into contact with the wiper blade 3, namely, the state where the blade cleaner 4 can clean the wiper blade 3 is referred to as the first position of the blade cleaner 4. Whereas, the state where the blade cleaner 4 is in a second posture in which the ink clearing away portion 4*a* of the blade cleaner 4 is retreated from the upper surface of the platen 8, and an ink receiving member (receiving member) 7 is located between the ink clearing away portion 4*a* of the blade cleaner 4 and the upper surface of the platen 8 is referred to as the second position of the blade cleaner 4. The ink receiving member 7 is configured so as to be able to receive the ink dropped down from the ink clearing away portion 4*a* in order to suppress dropping of the ink cleared away at the ink clearing away portion 4*a* of the blade cleaner 4 onto the upper surface of the platen 8, and the like in this second position.

The blade cleaner 4 has a rotation shaft 4*b*, and the rotation shaft 4*b* is rotatably supported by the bearing provided on the ink receiving member 7 integral with the carriage 1. As a result, the blade cleaner 4 is configured rotatably with respect to the carriage 1. The blade cleaner 4 is integrally provided with a blade cleaner switching projection 41A serving as a trigger for the rotational movement of the blade cleaner 4 (serving as a abutting portion to be imparted with a switching operation force for switching the posture of the blade cleaner 4). On the main body side, the main body side switching projection 51A serving as a trigger for causing the blade cleaner 4 to rotatably operate (serving as an action portion for imparting a switching operation force to the abutting portion) is provided in a fixed manner on the apparatus main body. Namely, the postural change of the blade cleaner 4 is implemented by the contact between the projection portion 41A as a first abutting portion, and the projection portion 51A as a first action portion, mutually relatively moving in the movement with respect to the apparatus main body of the carriage 1 (the details of which will be described later).

Incidentally, as the configuration for holding the posture (rotation phase) of the blade cleaner 4 in each of the first position and the second position, a spring urging configuration not shown may be included. Further, the position switching means of the blade cleaner 4 is not limited to the switching means by the trigger of the switching projection of the present embodiment 1. As for switching the blade cleaner 4, another driving source may be included.

Figure 3:
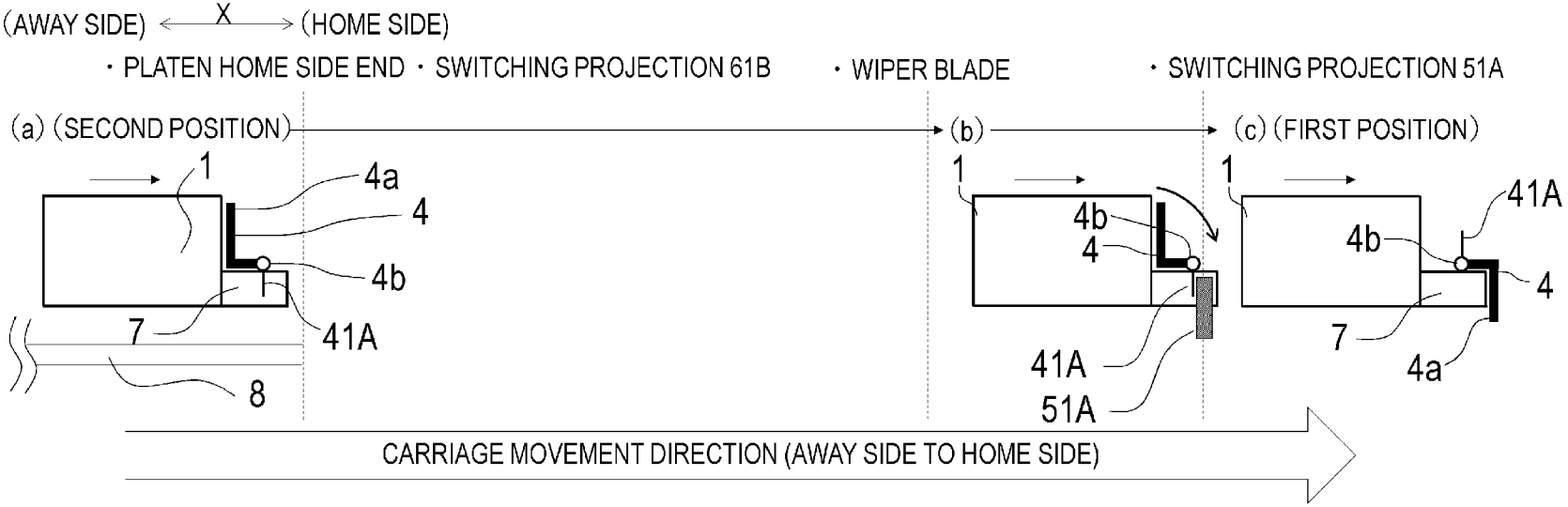
FIG. 3 is an explanatory view of the postural change of the blade cleaner (from the second posture to the first posture)

FIG. 3 illustrates the operation for transition of the posture of the blade cleaner 4 from the second position in which the ink receiving member 7 is located between the ink clearing away portion 4*a* and the upper surface of the platen 8 to the first position in which the wiper blade 3 can be cleaned by the ink clearing away portion 4*a*. The transition from the second position to the first position is carried out in accordance with the movement from the AWAY side to the HOME side in the main scanning direction of the carriage 1. State (a) in FIG. 3 shows the state in which the carriage 1 is in the print region, and the blade cleaner 4 is at the second position. In State (b) in FIG. 3, with the movement in the main scanning direction of the carriage 1, the main body side switching projection 51A and the blade cleaner switching projection 41A come into contact with each other, so that the blade cleaner 4 rotates. As a result, the blade cleaner 4 rotates to the first position (first phase) resulting in the posture in which the ink clearing away portion 4*a* protrudes to the side approaching the upper surface of the platen 8. State (c) in FIG. 3 shows the state after transition to the first position. At the first position, the blade cleaner 4 is put in the posture in which the ink clearing away portion 4*a* protruding to the position lower than the ink receiving member 7 can clean the wiper blade 3 not shown.

Figure 4:
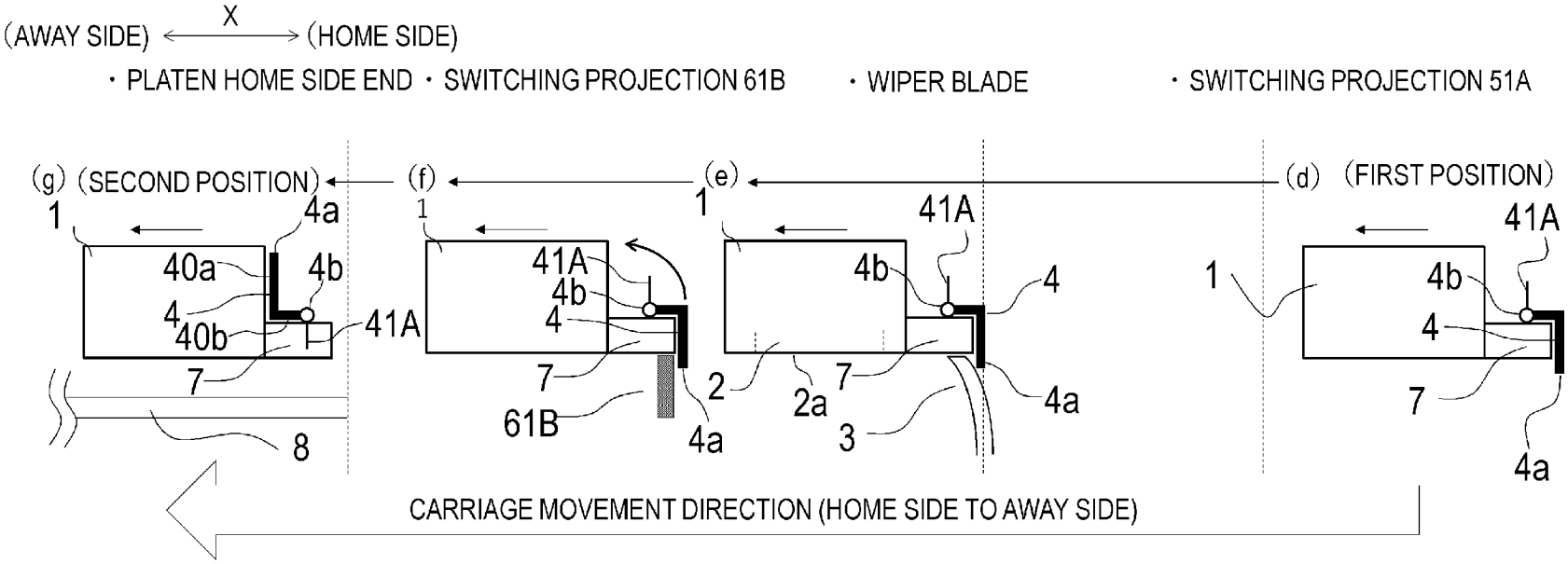
FIG. 4 is an explanatory view of the postural change of the blade cleaner (from the first posture to the second posture)

FIG. 4 shows the operation for transition of the posture of the blade cleaner 4 from the first position in which the ink clearing away portion 4*a* can clean the wiper blade 3 to the second position in which the ink receiving member 7 is located between the ink clearing away portion 4*a* and the upper surface of the platen 8. The transition from the first position to the second position is carried out in accordance with the movement from the HOME side to the AWAY side in the main scanning direction of the carriage 1. State (d) in FIG. 4 shows the state of the first position on the HOME side. In State (e) in FIG. 4, with the movement in the main scanning direction of the carriage 1, first, the wiper blade 3 comes into contact with the recording head 2, and wipes away ink droplets and foreign matters such as dust deposited on the recording head 2 in the direction from the AWAY side to the HOME side. Subsequently, (the ink clearing away portion 4*a* of) the blade cleaner 4 and the wiper blade 3 come into contact with each other, so that the blade cleaner 4 clears away the ink on the wiper blade 3. On the main body side, the main body side switching projection 61B serving as a trigger for causing the blade cleaner 4 to rotationally move is provided in a fixed manner on the apparatus main body. In State (f) in FIG. 4, with the movement in the main scanning direction of the carriage 1, the main body side switching projection 61B as a second action portion, and the ink clearing away portion 4*a* of the blade cleaner 4 as a second abutting portion come into contact with each other, so that the blade cleaner 4 rotates. As a result, the blade cleaner 4 rotates to the second position (second phase) in which the ink clearing away portion 4*a* is located higher than the ink receiving member 7, and over the ink receiving member 7. Namely, it results that the ink receiving member 7 is located between the blade cleaner 4 and the upper surface of the platen 8. State (g) in FIG. 4 shows the state of the second position after the carriage 1 has passed through the main body side switching projection 61B. Incidentally, the blade cleaner switching projection 41A and the ink clearing away portion 4*a* are arranged deviated from each other in the direction orthogonal to the main scanning direction of the carriage 1, and the main body side switching projection 51A and the main body side switching projection 61B are also arranged deviated from each other in the same direction.

Herein, the wiper blade 3 is configured reciprocally movably between the cleaning position capable of coming into contact with the recording head 2 and the retreat position which is below with respect to the cleaning position, and not to come into contact with the recording head 2 by a driving mechanism not shown. Namely, as shown in FIG. 3, when the carriage 1 moves from the AWAY side toward the HOME side in the main scanning direction, the wiper blade 3 is at the retreat position (accordingly, not shown in FIG. 3). On the other hand, as shown in FIG. 4, when the carriage 1 moves from the HOME side toward the AWAY side in the main scanning direction, the wiper blade 3 is at the cleaning position. Therefore, at this step, cleaning of the recording head 2 by the wiper blade 3 is performed. The wiper blade 3 shown in State (e) in FIG. 4 has had the ink thereon cleared away by the ink clearing away portion 4*a* of the blade cleaner 4 immediately after cleaning the recording head 2 at the cleaning position. The driving mechanism not shown moves the wiper blade 3 from the retreat position to the cleaning position in conjunction with the movement in the direction from the AWAY side toward the HOME side of the carriage 1. The timing at which the wiper blade 3 puts the head at the cleaning position is after the carriage 1 has passed through the setting position (cleaning position) of the wiper blade 3 in the migration path running from the AWAY side toward the HOME side. Subsequently, when the carriage 1 turns back from the end of the HOME side, and moves toward the AWAY side, the wiper blade 3 fixed at the cleaning position comes into contact with, and cleans the discharge port surface 2*a* of the recording head 2 moving with the carriage 1. Subsequently, when the carriage 1 passes through the cleaning position, the interlocking mechanism causes the wiper blade 3 to be retreated to the retreat position. As the driving mechanism for implementing the reciprocal movement of the wiper blade 3, for example, conventionally known mechanisms such as the driving mechanism described in Japanese Patent Application Publication No. 2007-160559 can be appropriately used.

In accordance with the present embodiment 1 as described above, the posture of the blade cleaner 4 keeps the second position when the carriage 1 is in the print region on the migration path, and switches to the first position when the carriage 1 enters the recovery operation region. The first position is the position for cleaning the wiper blade 3. The second position is the position for preventing dropping of the ink onto the upper surface of the platen 8, and the like during printing by the ink receiving member 7, and is also the position for recovering the ink clearing away performance of the blade cleaner 4. Namely, the tip of the ink clearing away portion 4*a* which has pointed downward at the first position comes to point upward at the second position. As a result, the ink deposited on the ink clearing away portion 4*a* moves so as to be separated from the ink clearing away portion 4*a* on the blade cleaner 4. Alternatively, in the case of a large deposition amount, or other cases, the ink moves along the blade cleaner 4 to the ink receiving member 7. As a result, the amount of the ink deposited at the ink clearing away portion 4*a* is reduced, resulting in an increase in amount of the ink cleared away at the ink clearing away portion 4*a* to be able to be retained. Namely, the ink clearing away performance of the blade cleaner 4 is recovered. As a result, it becomes possible to expect sufficient cleaning of the wiper blade 3 by the blade cleaner 4 for the subsequent cleaning.

Figure 10:
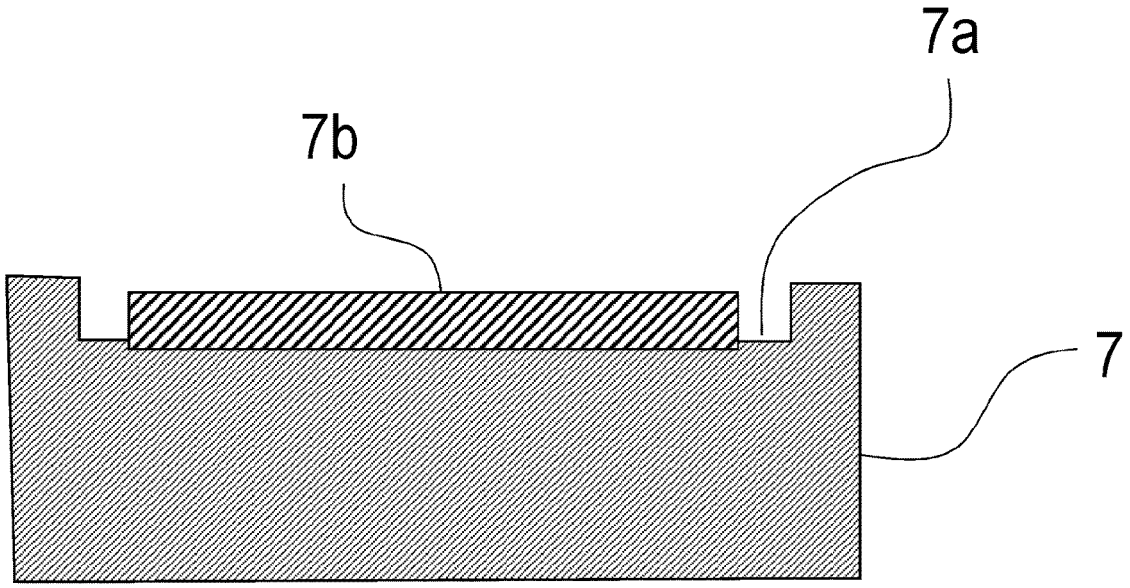
FIG. 10 is a schematic cross sectional view showing a schematic configuration of a configuration example of an ink receiving member.

Further, in the present embodiment 1, the wiper blade 3 can be cleaned by the blade cleaner 4 immediately after wiping, and the ink deposited on the wiper blade 3 can be cleared away before the ink becomes fixed thereto. Incidentally, the configuration of the ink receiving member 7 is not limited to the configuration of the present embodiment. For example, the configuration in which an absorber such as sponge formed of a material capable of absorbing an ink is incorporated, and the configuration formed in a saucer shape for receiving the cleared away ink are acceptable. As shown in FIG. 10, the respective configurations may be combined for the configuration. Namely, it may be configured as follows: the ink receiving member 7 has a concave saucer shaped portion 7*a* at the upper surface on which the blade cleaner 4 is mounted, and a sponge 7*b* is attached as an absorber at the saucer shaped portion 7*a*. The ink receiving member 7 should be configured so as to be able to surely receive the ink not only for dripping from the blade cleaner 4 (ink clearing away portion 4*a*) due to the gravity but also for scattering due to the vibration during the movement of the carriage 1, or the like. Therefore, the configuration of the ink receiving member 7 should also be appropriately designed according to the apparatus configuration, and it is naturally understood that the configuration can be a different configuration from the configuration shown in the present embodiment.

Figure 5:
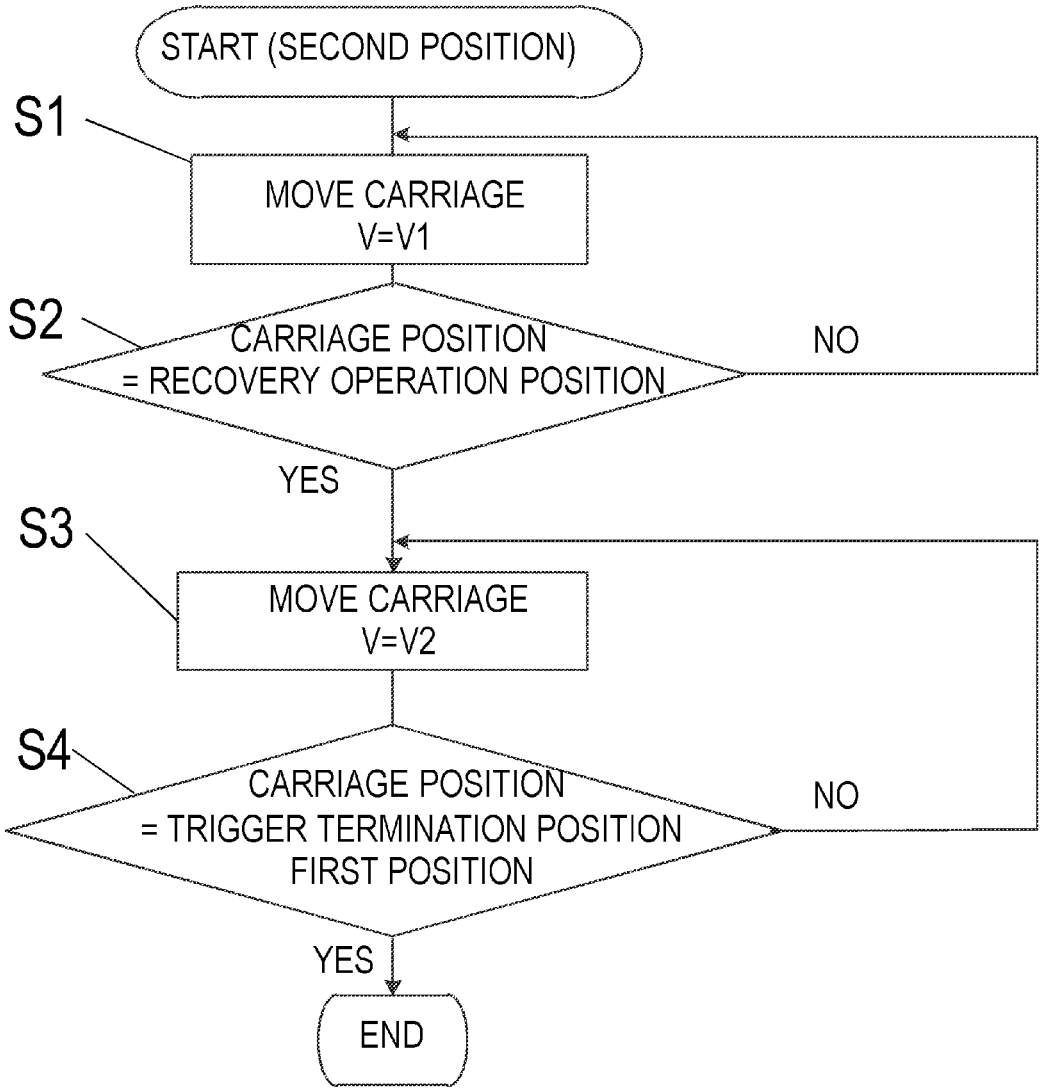
FIG. 5 is an operation flow of the postural change of the blade cleaner (from the second posture to the first posture)

FIG. 5 is a flowchart for illustrating the operation for transition of the posture of the blade cleaner 4 from the second position during printing to the first position during cleaning. First, in a step S1, the carriage 1 is moved from the AWAY side to the HOME side at a speed V1. Then, in a step S2, it is determined whether the carriage 1 has reached the recovery operation region or not. When the carriage 1 has not reached there, the movement of the carriage 1 to the recovery operation region is continued. When the carriage 1 has reached the recovery operation region, then, in a step S3, the carriage 1 is moved at a speed V2 slower than the speed V1. In a step S4, it is determined whether the carriage 1 has reached a first trigger termination position, or not. When the carriage 1 has not reached there, the movement of the carriage 1 to the first trigger termination position is continued. Herein, the first trigger termination position is the position at which the contact between the blade cleaner switching projection 41A and the main body side switching projection 51A terminates switching of the position of the blade cleaner 4. In order to perform switching of the position of the blade cleaner 4 with reliability, the moving speed of the carriage 1 is preferably set small. When it could be detected that the carriage 1 reached the first trigger termination position, it can be determined that the movement resulted in the transition of the blade cleaner 4 from the second position to the first position.

Figure 6:
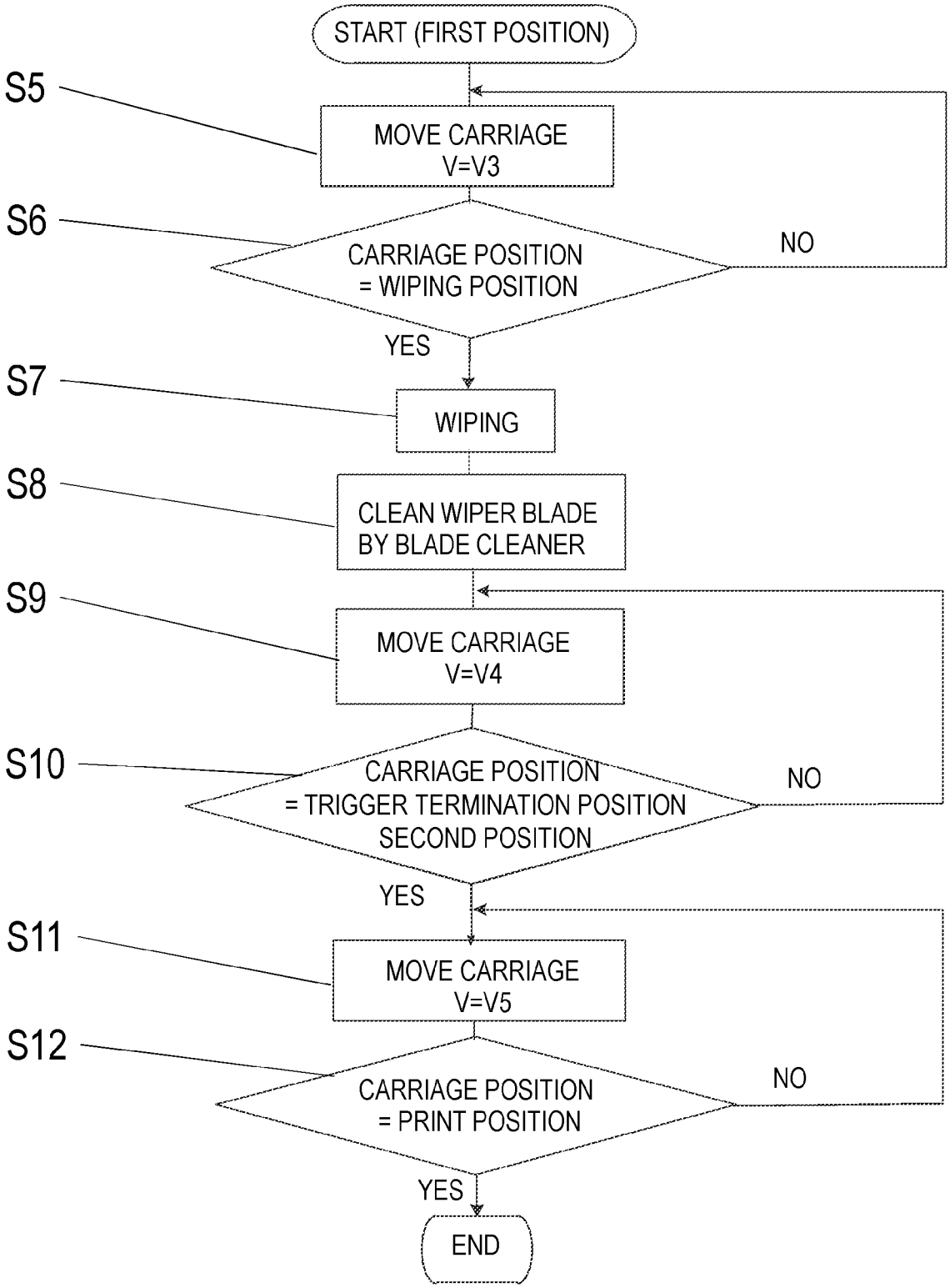
FIG. 6 is an operation flow of the postural change of the blade cleaner (from the first posture to the second posture)

FIG. 6 is a flowchart for illustrating the operation for the transition of the posture of the blade cleaner 4 from the first position during cleaning to the second position during printing. First, in a step S5, the carriage 1 is moved from the HOME side to the AWAY side at a speed V3. Then, in a step S6, it is determined whether the carriage 1 has reached the wiping position (wiping start position), or not. When the carriage 1 has not reached there, the movement of the carriage 1 to the wiping position is continued. Then, in a step S7, the wiper blade 3 wipes the discharge port surface 2*a* of the recording head 2. Herein, the speed of the carriage 1 is set at the speed V3 smaller than the speed V2, thereby improving the wiping performance of the discharge port surface 2*a* by the wiper blade 3. Subsequently, in a step S8, cleaning of the wiper blade 3 is carried out by the blade cleaner 4. Then, in a step S9, the carriage 1 is moved at a speed V4. In the present embodiment, the speed V4 is equal to the speed V2. In a step S10, it is determined whether the carriage 1 has reached a second trigger termination position, or not. When the carriage 1 has not reached there, the movement of the carriage 1 to the second trigger termination position is continued. Herein, the second trigger termination position is the position at which the contact between the ink clearing away portion 4*a* of the blade cleaner 4 and the main body side switching projection 61B terminates switching of the position of the blade cleaner 4. When it could be detected that the carriage 1 reached the second trigger termination position, it can be determined that the movement resulted in the transition of the blade cleaner 4 from the first position to the second position. Subsequently, in a step S11, the carriage 1 is moved at a speed V5. In the present embodiment, the speed V5 is equal to the speed V1. In a step 12, it is determined whether the carriage 1 has reached the print region, or not. When the carriage 1 has not reached there, the movement of the carriage 1 to the print region is continued.

Incidentally, in the present embodiment, the speeds V1 to V5 were set as V1=V5>V2=V4>V3. However, the speeds of the speeds V1 to V5 may be the same, or may be respectively different speeds as the optimum speeds for respective operations.

The present embodiment is configured to use a generally L-shaped sheet-shaped member 40 as the blade cleaner 4. The sheet-shaped member 40 has a first sheet portion 40*a* having the ink clearing away portion 4*a*, and a second sheet portion 40*b* in contact with one side of the first sheet portion 40*a* in the direction orthogonal to the first sheet portion 40*a*. The second sheet portion 40*b* serves as a positioning portion for defining the position with respect to the carriage 1 (ink receiving member 7). The second sheet portion 40*b* is provided with a rotation shaft 4*b* at the side opposite to the connecting side to the first sheet portion 40*a*. When the blade cleaner 4 is at the first position, one surface of the second sheet portion 40*b* comes into contact with the upper surface of the ink receiving member 7, and serves as a positioning portion for determining the position of the blade cleaner 4 at the first position with respect to the carriage 1. Whereas, when the blade cleaner 4 is at the second position, the other surface of the second sheet portion 40*b* comes into contact with the upper surface of the ink receiving member 7, and serves as a positioning portion for determining the position of the blade cleaner 4 at the second position with respect to the carriage 1.

The posture switching of the blade cleaner 4 can be implemented by the following configuration: for example, with the foregoing spring urging mechanism, the blade cleaner 4 and the ink receiving member 7 are coupled with each other by an urging member such as a spring, and the rotation due to the contact with the projection 51A or the projection 61B changes how the urging force is applied. Namely, it is configured such that switching is caused with a prescribed angle around the rotation shaft 4*b* as the boundary between a first urging state in which the urging force of the urging member acts so as to displace the blade cleaner 4 to the first position, and a second urging state in which the urging force acts so as to displace the blade cleaner 4 to the second position.

Posture switching of the blade cleaner 4 is not limited to the foregoing configuration. Examples of the configuration not using an urging member such as a spring may include the configuration using setting of the balance of center of gravity of the sheet-shaped member 40 and a magnet. Namely, it is configured such that the position of the center of gravity of the sheet-shaped member 40 is rotated in the postural change direction by the gravity after being rotated to a prescribed angle triggered by the contact with the projection 51A or the projection 61B. Then, when the state is caused where the sheet-shaped member 40 comes into contact with, or comes close to the ink receiving member 7, the sheet-shaped member 40 is adsorbed on the contact position with the ink receiving member 7 resisting the gravity by the magnetic force of the magnets respectively included in the sheet-shaped member 40 and the ink receiving member 7. The magnetic force is set with a magnitude capable of keeping the position against the vibration during the movement of the carriage 1, and weak enough to release the adsorption state due to the contact with the projection 51A or the projection 61B. Such a configuration can also produce the same effects as those in the embodiment.

Embodiment 2

Referring to FIGS. 7A, 7B to 9, Embodiment 2 of the present invention will be described. The configuration common to Embodiment 1 in Embodiment 2 is given the same reference numeral and sign, and will not be described again. The matters herein not particularly described in Embodiment 2 are the same as those in Embodiment 1.

Figure 7A:
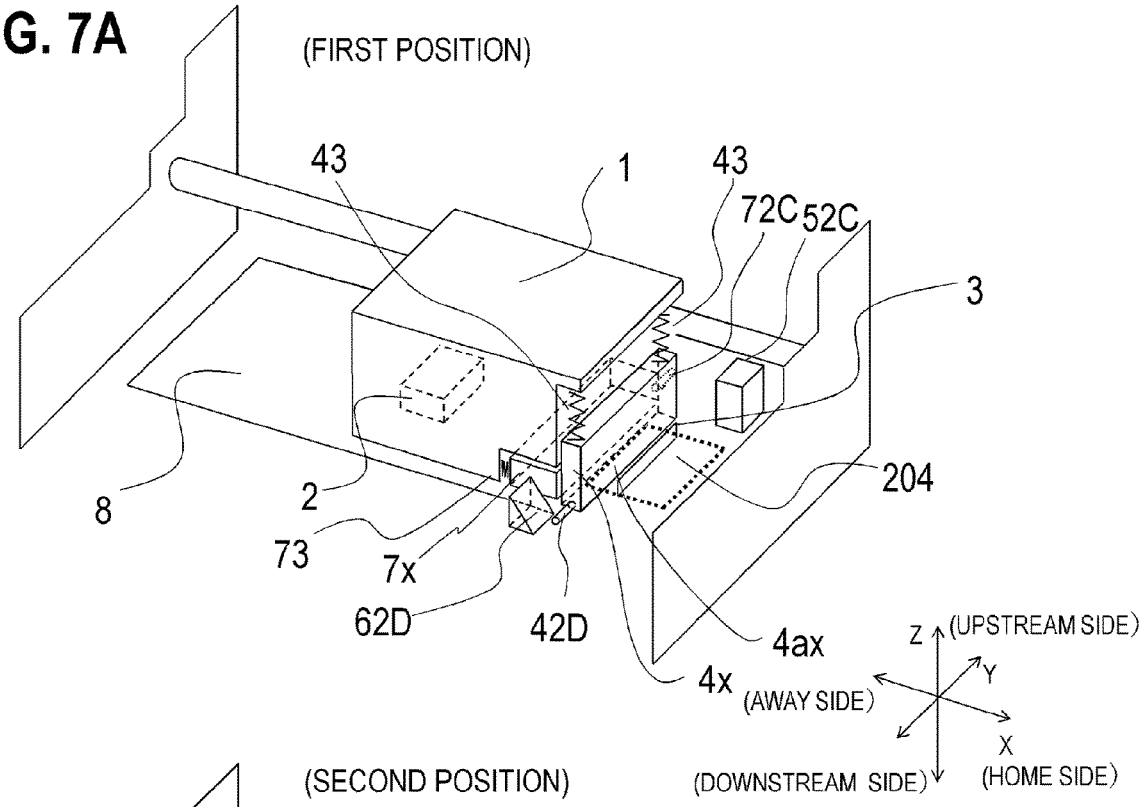
FIGS. 7A and 7B are a perspective views showing the outline of a recording apparatus and a recovery apparatus in Embodiment 2 of the present invention.
Figure 7B:
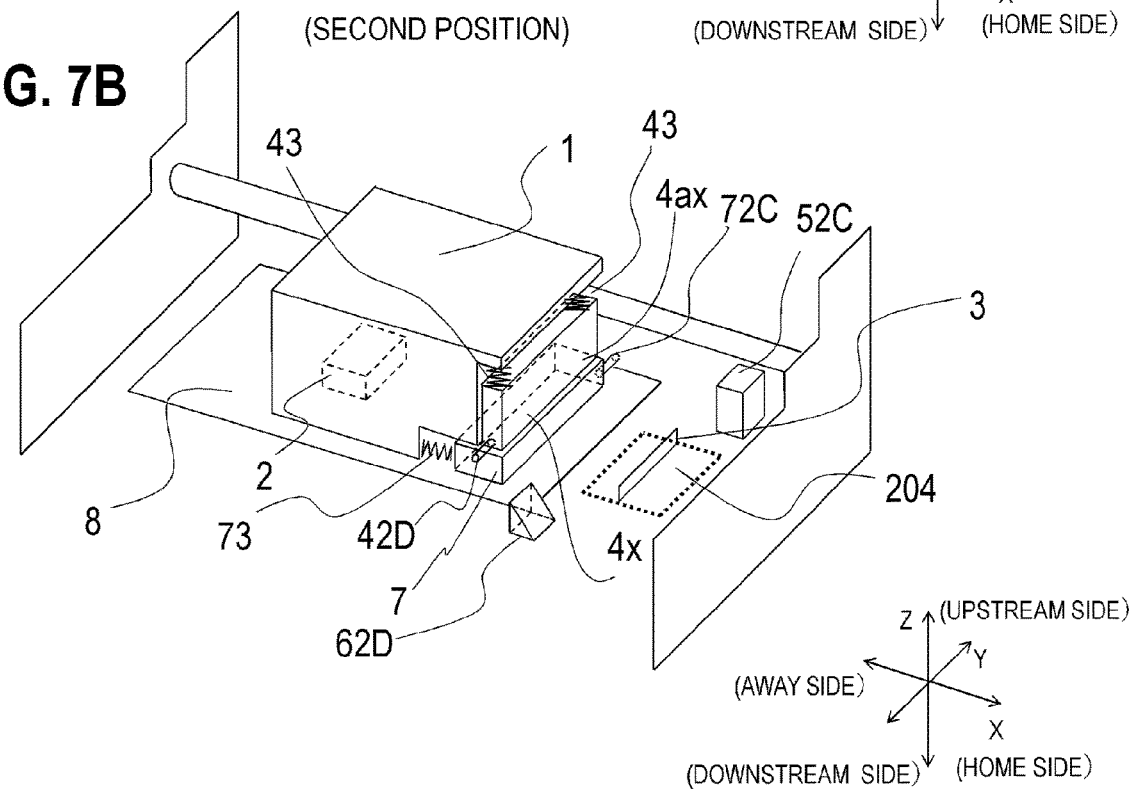

FIGS. 7A and 7B are perspective views showing the state where a blade cleaner 4*x*, a platen 8, and the like configured in the carriage 1 in Embodiment 2 of the present invention are incorporated. The state in which the blade cleaner 4*x* protrudes toward the side approaching the upper surface of the platen 8, and can clean the wiper blade 3 is referred to as a first position. Whereas, the state in which an ink receiving member 7*x* for suppressing dropping of the ink cleared away by the blade cleaner 4*x* is located between the blade cleaner 4*x* and the upper surface of the platen 8 is referred to as a second position.

The blade cleaner 4*x* is configured movably in the Z direction with respect to the carriage 1, and is urged downward in the Z direction by a blade cleaner spring 43. Further, the blade cleaner 4*x* is integrally provided with a blade cleaner switching projection 42D serving as a trigger for movement in the Z direction. The ink receiving member 7*x* is configured movably in the X direction, and is urged to the HOME side in the X direction by an ink receiving member spring 73. The ink receiving member 7*x* is configured so as to be able to get into between the blade cleaner 4*x* and the upper surface of the platen 8 with the movement of the blade cleaner 4*x* upward in the Z direction. Further, the ink receiving member 7*x* is integrally provided with an ink receiving member switching projection 72C serving as a trigger for the movement.

Figure 8:
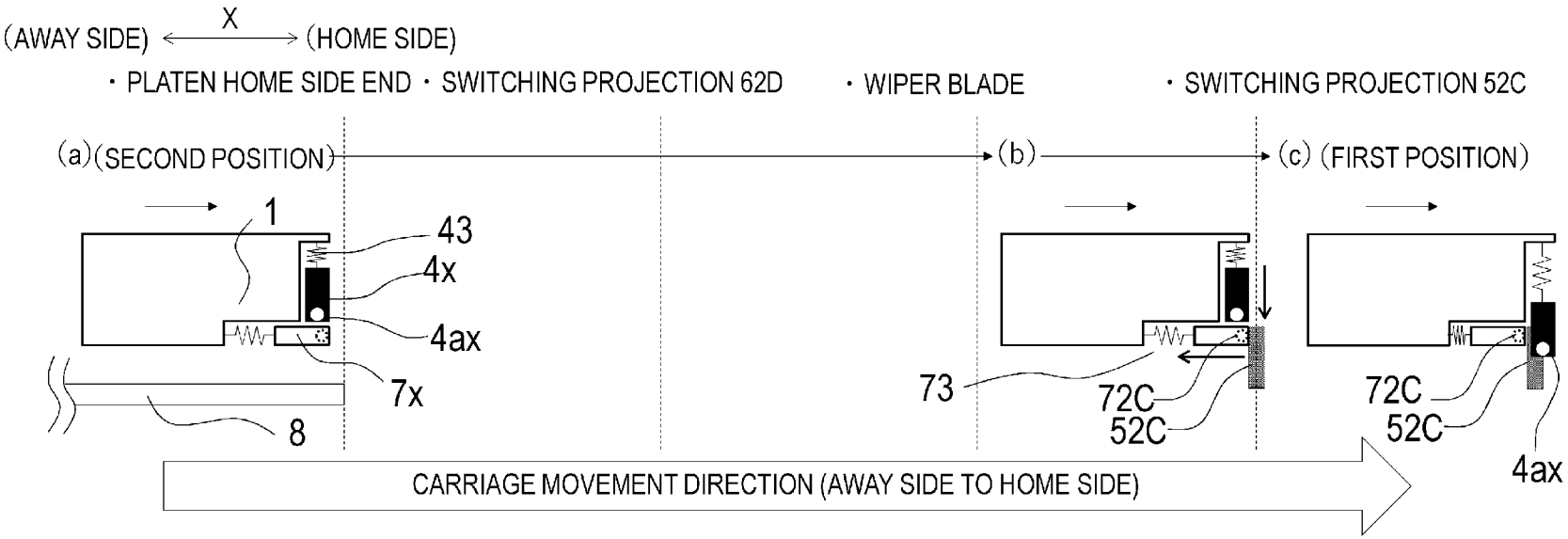
FIG. 8 is an explanatory view of the postural change of the blade cleaner (from the second posture to the first posture)

FIG. 8 shows the operation for the transition from the second position at which the ink receiving member 7*x* is located between the blade cleaner 4*x* and the upper surface of the platen 8, to the first position at which the ink clearing away portion 4*ax* can clean the wiper blade 3 (not shown in FIG. 8). The transition from the second position to the first position of the blade cleaner 4*x* is carried out with the movement of the carriage 1 from the AWAY side to the HOME side in the main scanning direction. State (a) in FIG. 8 shows the state in which the carriage 1 is in the print region, and the blade cleaner 4*x* is at the second position. The ink receiving member 7*x* is urged to the HOME side in the X direction by the ink receiving member spring 73. Further, the blade cleaner 4*x* is urged to the upper surface portion of the ink receiving member 7*x* by the blade cleaner spring 43. In State (b) in FIG. 8, with the movement in the main scanning direction of the carriage 1, the main body side switching projection 52C as a first action portion and the ink receiving member switching projection 72C as a first abutting portion come into contact with each other, and the ink receiving member 7*x* is moved to the AWAY side in the X direction by spring urging. In conjunction with this, the blade cleaner 4*x* moves downward in the Z direction, and gests into the space vacated by the movement of the ink receiving member 7*x*, resulting in transition to the first position. At the first position, the ink receiving member 7*x* is urged to the side surface on the AWAY side of the blade cleaner 4*x* by the ink receiving member spring 73. State (c) in FIG. 8 shows the state after transition to the first position.

At the first position, the blade cleaner 4*x* is arranged at the position capable of cleaning the wiper blade 3 not shown by the ink clearing away portion 4*ax*.

Figure 9:
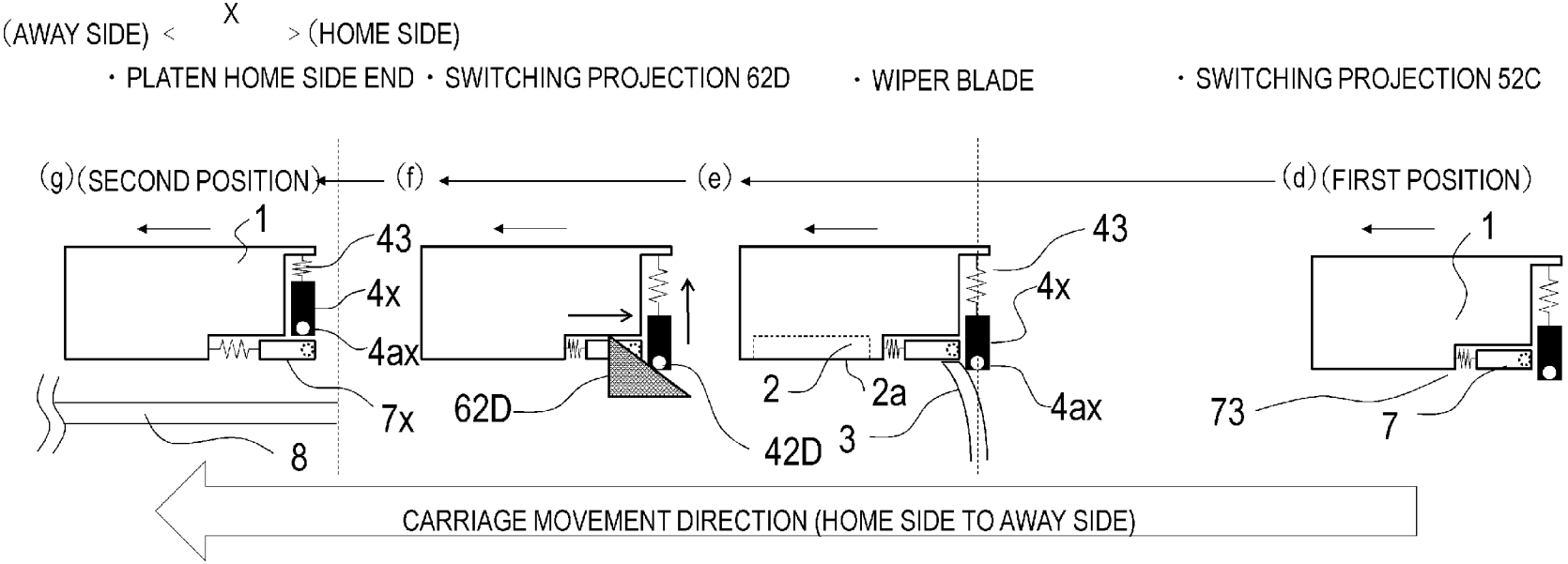
FIG. 9 is an explanatory view of the postural change of the blade cleaner (from the first posture to the second posture)

FIG. 9 shows the operation for the transition of the posture of the blade cleaner 4*x* from the first position at which the ink clearing away portion 4*ax* can clean the wiper blade 3 to the second position at which the ink receiving member 7 is located between the ink clearing away portion 4*ax* and the upper surface of the platen 8. The transition from the first position to the second position is carried out with the movement in the main scanning direction from the HOME side to the AWAY side of the carriage 1. State (d) in FIG. 9 shows the state of the first position on the HOME side. In State (e) in FIG. 9, with the movement in the main scanning direction of the carriage 1, first, the wiper blade 3 comes into contact with the discharge port surface 2*a* of the recording head 2, and wipes away the ink droplets and foreign matters such as dust deposited at the discharge port surface 2*a* while moving in the direction from the AWAY side to the HOME side. Subsequently, (the ink clearing away portion 4*ax*) of the blade cleaner 4*x* and the wiper blade 3 come into contact with each other, and the ink on the wiper blade 3 is cleared away by the blade cleaner 4*x*. In State (f) in FIG. 9, with the movement in the main scanning direction of the carriage 1, the blade cleaner switching projection 42D as a second abutting portion comes into contact with the main body side switching member 62D as a second action portion. The blade cleaner switching projection 42D comes into contact along the slope of the main body side switching member 62D, so that the blade cleaner 4*x* moves upward in the Z direction. The ink receiving member 7*x* moves to the HOME side in the X direction, and gets into the space vacated by the movement of the blade cleaner 4*x*, resulting in transition to the second position. At the second position, the blade cleaner 4*x* is urged to the upper surface portion of the ink receiving member 7*x* by the blade cleaner spring 43. State (g) in FIG. 9 shows the state of the second position capable of printing after the blade cleaner 4*x* has passed through the main body side switching projection 62D.

At the second position which is the retreat position retreated from the cleaning position, the blade cleaner 4*x* is mounted on the upper surface of the ink receiving member 7*x*, namely, is supported by the ink receiving member 7*x*. This can also be said that the ink receiving member 7*x* is in a regulating state (regulating position) for regulating the postural change of the blade cleaner 4*x* at the second position into the posture capable of cleaning of the first position. The ink receiving member 7*x* is configured movably only in the X direction by a guide mechanism not shown, and the blade cleaner 4*x* is also configured movably only in the Z direction. Namely, the ink receiving member 7*x* is configured so as to keep the posture against the weight of the blade cleaner 4*x* acting downward in the Z direction, and the urging force from the blade cleaner spring 43 by the support of a guide mechanism not shown. Incidentally, the blade cleaner 4*x* may also be configured so as not to be displaced in the X direction, and so as to move only in the Z direction upon contact with the main body side switching member 62D by the guide mechanism not shown.

In the transition from the second position to the first position, the ink receiving member 7 retreats from under the blade cleaner 4*x*. This can also be said that the ink receiving member 7*x* is put in an allowable state (allowable position) for allowing the postural change of the blade cleaner 4*x* at the second position into the posture capable of cleaning of the first position. As a result, the blade cleaner 4*x* loses the support by the ink receiving member 7*x*, and becomes suspended from the blade cleaner spring 43. The blade cleaner spring 43 is elongated by the weight of the blade cleaner 4*x*. At this step, the ink clearing away portion 4*ax* at the lower end of the blade cleaner 4*x* protrudes downward, resulting in the first position (cleaning position) of the state capable of cleaning the wiper blade 3.

In accordance with the present embodiment 2 as described above, the ink receiving member 7*x* also has functions of preventing dropping of the ink onto the upper surface of the platen 8, and the like from the blade cleaner 4*x* at the second position, and recovering the ink clearing away ability. Namely, the ink receiving member 7*x* receives the ink running down from the ink clearing away portion 4*ax* due to the gravity while supporting the blade cleaner 4*x* at the second position. As a result, the ink deposition amount at the ink clearing away portion 4*ax* is reduced, and the ink retainable amount is recovered. Namely, the ink clearing away performance of the blade cleaner 4*x* is recovered. As a result, at the subsequent cleaning time, sufficient cleaning of the wiper blade 3 by the blade cleaner 4*x* can be expected. Further, in the present embodiment 2, the wiper blade 3 can be cleaned by the blade cleaner 4*x* immediately after wiping, and the ink deposited on the wiper blade 3 can be cleaned away before being fixed. Incidentally, the configuration of the ink receiving member 7*x* is not limited to a specific configuration. For example, the configuration in which an absorber such as sponge formed of a material absorbing an ink is incorporated, and the configuration formed in a saucer shape for receiving the cleared away ink are possible. The ink receiving member 7*x* should be configured so as to surely receive the ink not only for drips from the blade cleaner 4*x* (ink clearing away portion 4*ax*) due to the gravity, but also for scattering caused by vibration during the movement of the carriage 1, and the like. Therefore, the configuration of the ink receiving member 7*x* should also be appropriately designed according to the apparatus configuration, and it is naturally understood that a different configuration from the configuration shown in the present embodiment can be implemented.

In Embodiment 2, the flowchart for illustrating the operation is equal to the flowcharts shown in FIGS. 5 and 6 of Embodiment 1.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-100426, filed on Jun. 9, 2020, which is hereby incorporated by reference herein in its entirety.

What is claimed is:

1. A recording apparatus comprising:

a carriage configured to mount a recording head having a discharge port surface including a discharge port for discharging a liquid, and to move in a scanning direction;

a platen configured to support a recording medium at a position facing the discharge port surface;

a wiper configured to wipe the discharge port surface by relatively moving with respect to the recording head due to a movement of the carriage;

a cleaner member provided on the carriage and configured to clean the wiper by moving with the carriage; and a receiving member provided on the carriage and configured to receive a liquid cleared away from the wiper by the cleaner member, wherein the cleaner member is in a first position capable of cleaning the wiper in a state where the carriage is not above the platen and is in a second position allowing the receiving member to receive the liquid in a state where the carriage is above the platen.

2. The recording apparatus according to claim 1, wherein, in a state where the carriage is not above the platen, the wiper wipes the discharge port surface.

3. The recording apparatus according to claim 1, wherein the receiving member includes an absorber capable of absorbing the liquid.

4. The recording apparatus according to claim 1, wherein the receiving member has a saucer shape for receiving the liquid.

5. The recording apparatus according to claim 1, wherein the cleaner member has a contact portion for coming into contact with the wiper, and is mounted displaceably to the carriage such that a position of the contact portion at the carriage changes, at the first position, the contact portion can come into contact with the wiper, and at the second position, the receiving member is located between the contact portion and the platen.

6. The recording apparatus according to claim 1, wherein the cleaner member is in either the first position or the second position by contacting with an action portion fixed at a main body of the recording apparatus in a case where the carriage moves in the scanning direction.

7. The recording apparatus according to claim 6, wherein the action portion includes a first action portion for displacing the cleaner member from the second position to the first position, and a second action portion for displacing the cleaner member from the first position to the second position.

8. The recording apparatus according to claim 7, wherein the cleaner member has a first abutting portion that comes into contact with the first action portion, and a second abutting portion that comes into contact with the second action portion in a case where the carriage moves in the scanning direction.

9. The recording apparatus according to claim 7, wherein the cleaner member and the receiving member are each mounted displaceably to the carriage, wherein the receiving member has a first abutting portion that comes into contact with the first action portion in a case where the carriage moves in the scanning direction, and wherein the cleaner member has a second abutting portion that comes into contact with the second action portion in a case where the carriage moves in the scanning direction, in conjunction with a movement of the receiving member due to contact of the first action portion with the first abutting portion, the cleaner member moves from the second position to the first position, and the second action portion comes into contact with the second abutting portion, such that the cleaner member moves from the first position to the second position.

10. The recording apparatus according to claim 9, wherein the cleaner member can move between a cleaning position, at which a clearing away portion for coming into contact with the wiper and clearing away the liquid can come into contact with the wiper, as the first position, and a retreat position, which is separate from the cleaning position, as the second position, and wherein the receiving member can move between a regulating position for regulating a movement of the cleaner member from the retreat position to the cleaning position and an allowable position for not regulating the movement, and is located between the clearing away portion and the platen at the regulating position.

11. The recording apparatus according to claim 1, wherein the cleaner member is mounted rotatably with respect to the receiving member, and wherein a rotation phase of the cleaner member with respect to the receiving member is in a first phase at which a contact portion for coming into contact with the wiper is at a position lower than that of the receiving member at the first position, and is in a second phase at which the contact portion is located higher than the receiving member at the second position.

* * * * *